United States Patent [19]

Rautimo et al.

[11] 3,996,127

[45] Dec. 7, 1976

[54] DEVICE FOR DETACHING AN ELECTROLYTICALLY PRECIPITATED METAL SHEET FROM A CATHODE

[75] Inventors: Pentti J. Rautimo, Helsinki; Aarne A. Kapanen, Pori, both of Finland

[73] Assignee: Outokumpu Oy, Helsinki, Finland

[22] Filed: Nov. 10, 1975

[21] Appl. No.: 630,508

Related U.S. Application Data

[62] Division of Ser. No. 407,208, Oct. 17, 1973, Pat. No. 3,935,091.

[52] U.S. Cl. ..... 204/281; 156/584; 204/198

[51] Int. Cl.[2] ..... C25C 7/08; C25D 1/20

[58] Field of Search ..... 156/584; 204/12, 198, 204/226, 281

[56] References Cited

UNITED STATES PATENTS

| | | | |
|---|---|---|---|
| 3,124,521 | 3/1964 | Sviadoshich et al. | 204/194 |
| 3,625,806 | 12/1971 | Wennberg | 156/584 |
| 3,847,779 | 11/1974 | Sekine et al. | 204/198 |

*Primary Examiner*—F.C. Edmundson
*Attorney, Agent, or Firm*—Brooks, Haidt, Haffner & Delahunty

[57] ABSTRACT

Electrolytically precipitated metal sheets, such as copper, nickel or zinc sheets, are detached from a base plate having worked as a cathode during precipitation and being rigidly held in a vertical position. Firstly, the upper edge of the metal sheet is detached entirely or locally by the aid of a blade system and, thereafter, said detached edge portion is grabbed with gripping means and pulled outwards essentially in a horizontal direction until the entire metal sheet is detached from the base plate. To facilitate the initial detachment an insulating tape or similar may be glued to the base plate at the solution level before precipitation. The gripping means may be connected to essentially horizontal guide means provided with driving members for creating the pulling force.

1 Claim, 8 Drawing Figures

DEVICE FOR DETACHING AN ELECTROLYTICALLY PRECIPITATED METAL SHEET FROM A CATHODE

This is a division of application Ser. No. 407,208, filed Oct. 17, 1973, now U.S. Pat. No. 3,935,091.

BACKGROUND OF THE INVENTION

1. Field of the Invention

The present invention relates to a method and device for detaching an electrolytically precipitated metal sheet, especially a copper, nickel, or zinc sheet, from a base plate which works as a cathode and which is kept in an essentially vertical position.

2. Description of the Prior Art

The detachment of cathodally precipitated metal sheets (especially a copper, nickel, or zinc sheet) in an electrolytic system is usually achieved manually. Various tools are used for the detachment, such as a chisel or scrapers, which damage the base plate working as a cathode in long-term use and make the detachment from the scratched plate difficult. Various mechanized methods have been suggested to facilitate this working stage, which is of considerable technological and economic importance in the electrolytic production of metal. Some of these methods are detaching of the metal sheet with a suction cup device (Finnish patent application No. 1879/71), with a pneumatic or hydraulic spray device (U.S. Pat. No. 3,501,385 and Finnish patent application No. 2856/70), with a vibrator (Finnish patent application No. 3254/72), with vertically moving blades or a guillotine (Belgian Pat. No. 758,783), or by a rolling-mangling treatment. For example, German patent application No. 1,904,104 introduces a device provided with a detachment blade which moves up and down on both sides of the base plate over the entire height of the plate and which is guided by guide members so that during the detaching movement it is in contact with the plate and during the return movement it is clear from the plate. Furthermore, the device contains members for holding on to the base plate during the detachment operation and slanted side plates for receiving the detached copper sheets. Besides being mechanically complicated and expensive these known methods and devices either damage the base plate or are slow and poorly applicable to mass production. The yield of faultlessly detached sheets in proportion to the amount fed into the process also remains too low.

SUMMARY OF THE INVENTION

The present invention provides a method of the character once described, which comprises initially detaching the upper edge of the precipitated sheet at least locally by a blade system forced between the base plate and the metal sheet, then gripping the opened upper edge of the precipitated metal sheet firmly and pulling the sheet sidewards essentially horizontally until the entire metal sheet is detached from the base plate.

A preferred device for carrying out said method comprises means for holding the base plate rigidly in an essentially vertical position during the detaching operation, a blade system for detaching the upper edge of the precipitated metal sheet either entirely or locally from the base plate, gripping jaws for gripping said detached upper edge portion, and a horizontal pulling device connected to the gripping jaws and provided with essentially horizontal guides and driving members for creating of the pulling force.

It is an object of the invention to provide a method and device which make it possible to detach a metal sheet automatically in one working stage and yields a faultless straight sheet product without damaging the surface of the cathode base plate.

Thus the invention comprises two essential parts. One of them is a hydraulically/pneumatically working blade system for the initial detachment of the sheet, and the other is an actual horizontal pulling device which immediately grips the opened upper edge of the sheet with its gripping members and, moving on a mainly horizontal track, peels the sheet from the base plate and transfers the detached sheet automatically to a sheet stack controlled by a stacking device.

The detachment of the sheet preferably takes place simultaneously from both sides of the base plate. The opening mechanism of the upper edge preferably consists of two or more pneumatically/hydraulically working blades positioned above the level of the upper edge of the sheet. The opening blade may be attached to the piston arm of a working cylinder so that its path of movement is directed slantingly down to the upper edge of the plate (i.e. the solution level). The blade cylinder is preferably provided with bearings at its upper end so that the cylinder and the blade can turn around a horizontal axis. The downward movement of the blade is achieved with such a force (e.g. 100 kp) that the blade penetrates between the sheet and the base plate only so much that the upper edge of the sheet opens either at the area of the blade or over its entire width, thereby making it possible for the gripping means of the horizontal pulling device to grip the upper edge of the plate.

The necessary pressure of the blade against the base plate (e.g. 100 kp) at the opening stage is achieved by means of an auxiliary cylinder. When the blade has reached its extreme position below, which usually corresponds to a penetrating depth of 2–10 cm, the auxiliary cylinder moves the blade and the working cylinder away from the base plate by means of a change of direction, whereby the upper edge portion opens even more, thereby ensuring the gripping of the gripping jaws of the horizontal pulling device. It should be noted that, taking into consideration the variations of the sheet material, the thrusting depth and the approach angle of the blade are limited by blade movement control so that only the upper edge of the sheet is opened and the opening operation is not continued downwards with the blades. This prevents a wrinkling and cutting of the sheet and damaging scratches to the base plate.

The horizontal pulling device preferably works hydraulically/pneumatically and moves along guide rails which are at the level of the upper edge of the sheet and perpendicular (on each side) to the surface of the base plate. Two or more pairs of pneumatically/hydraulically working gripping jaws may be attached to the carriage of the pulling device. The carriage has two extreme positions on its path of movement. A movement of 100 % to the end position brings the gripping jaws onto the sheet to be detached, at which time they close and grip the opened upper edge of the sheet. When the pulling device returns to the initial position of 0 %, the sheet becomes detached from the base plate and is turned, for example, by a block stop to an almost horizontal position, and the sheet detached by the gripping jaws, when these have received an opening order, is placed on the sheet stack of a stacking device underneath the detachment station.

After the horizontal pulling device has peeled the sheet off during its return movement, the opening of the gripping jaws is timed so that the sheet falls on the sheet stack exactly in the correct position. This can be achieved by the correct choice of a jaw structure and by means of a rapid exhaust valve.

The detaching force of the horizontal pulling device in the direction of the track is, for example, 400 kp, which makes it possible to peel the sheet in a faultlessly straight form. Usually an average force of 25 kp is sufficient for detaching a copper sheet.

The mechanical movements of both the opening blades of the upper edge of the sheet and the horizontal pulling device can be precisely regulated, controlled and limited in relation to each given station.

Especially for copper, but also for nickel and zinc, a plastic solution level band or tape can be used for the precise placement of the upper edge of the sheet and for facilitating the initial detachment; this band is attached to the base plate at the solution level. It also works as a guide and slide base for the opening blades.

DESCRIPTION OF THE PREFERRED EMBODIMENTS

Figure 1:
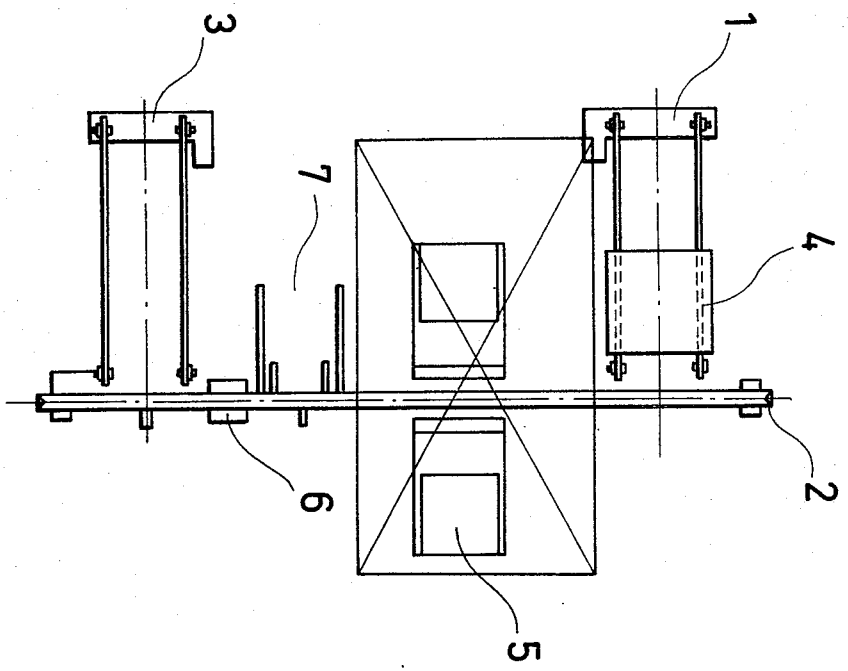
FIG. 1 shows schematically an example of the placement of the conveyors and the detachment station.
Figure 2:
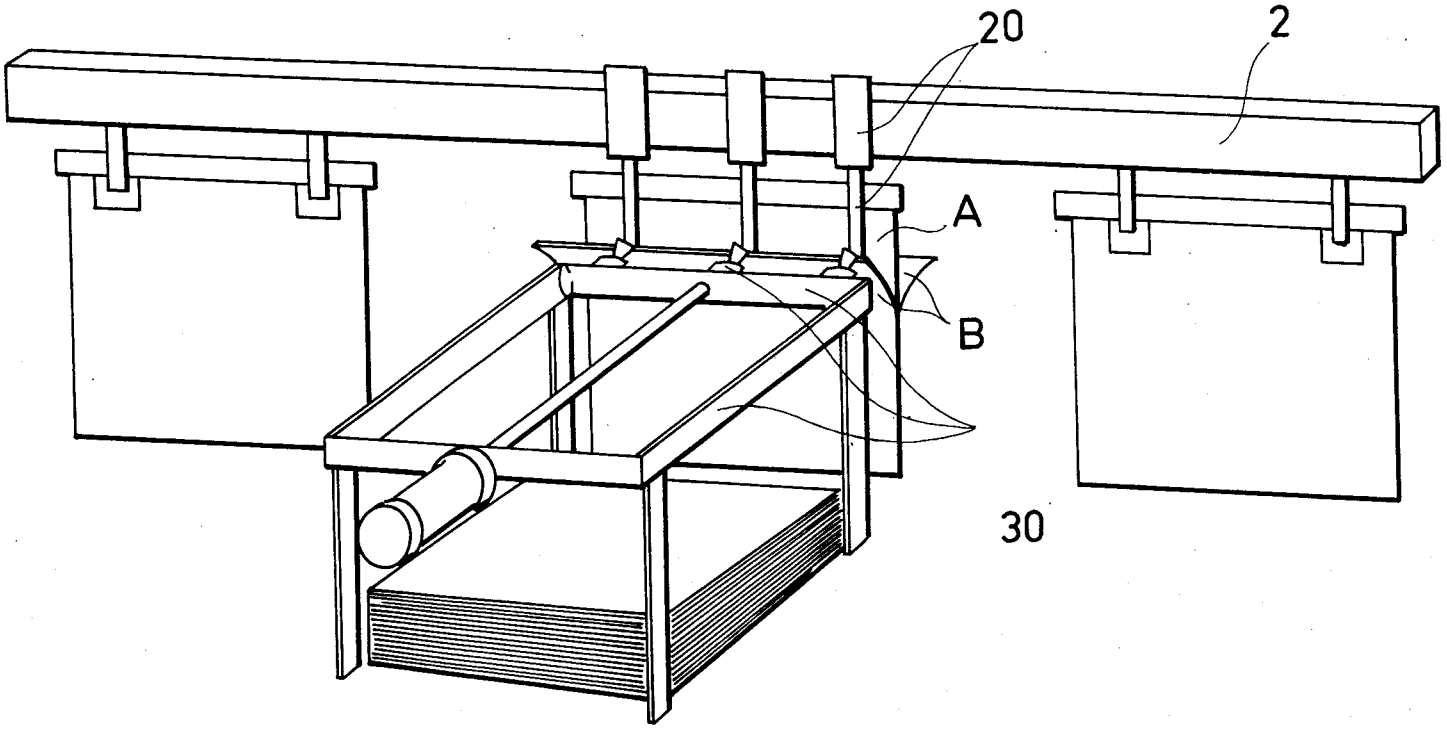
FIG. 2 is a drawing of the position of the detachment station on the track.
Figure 3:
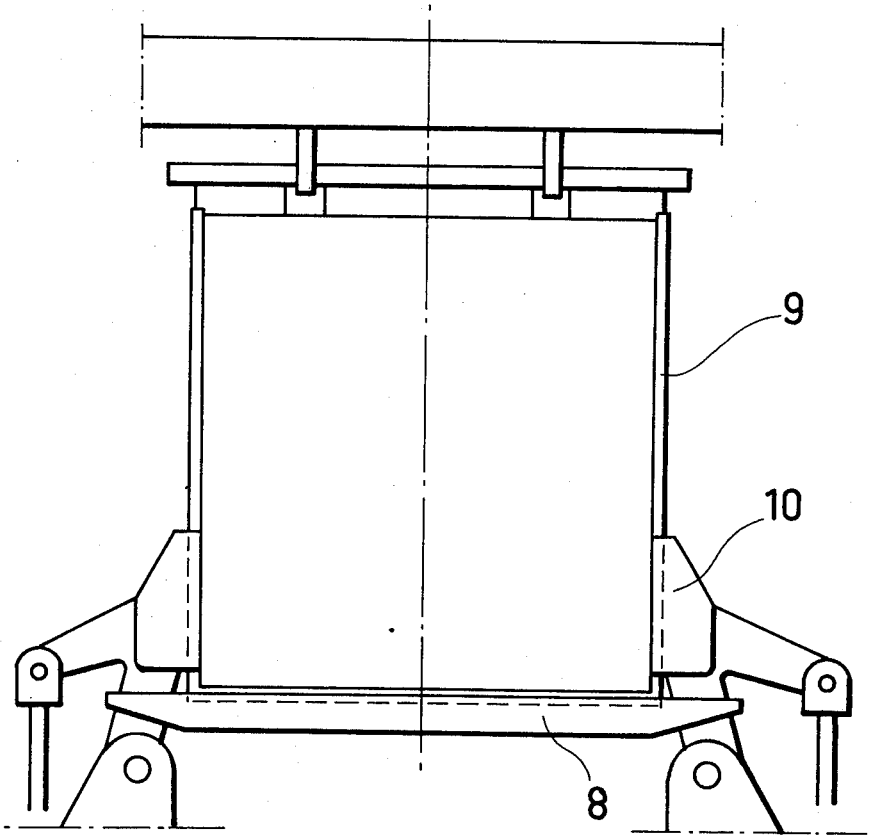
FIG. 3 shows the edge lists of the base plate and its guides and attachment shoes at the detachment station.
Figure 4A:
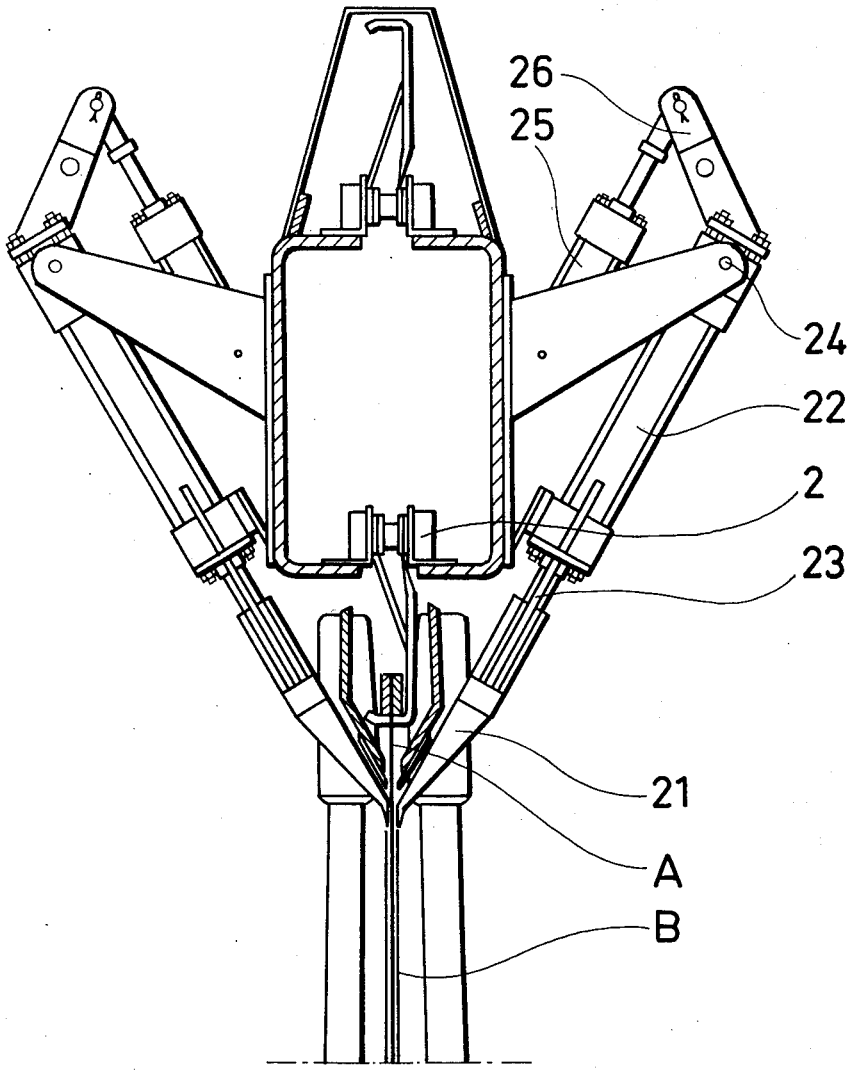
FIGS. 4*a* and 4*b* show two embodiments of the opening blade and gripping members for the upper edge of the sheet.
Figure 4B:
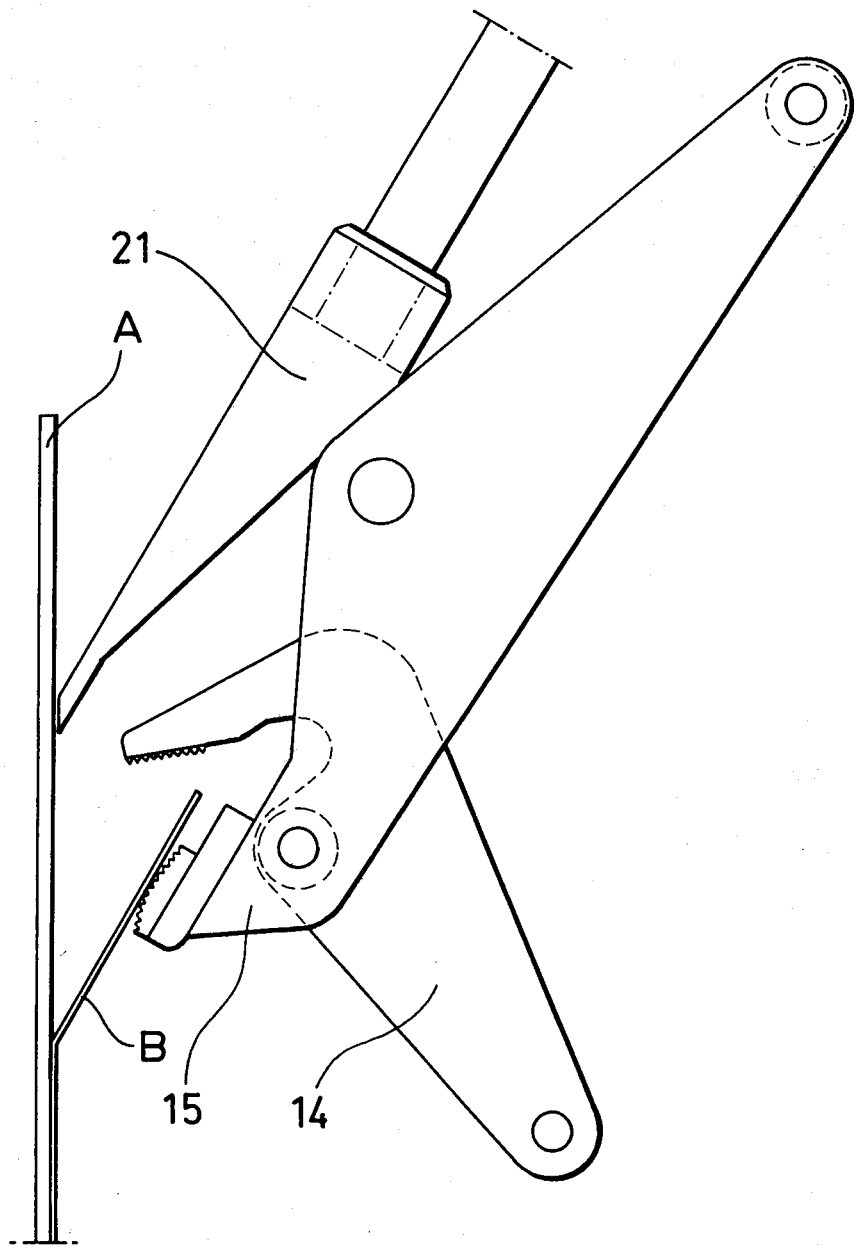
Figure 5:
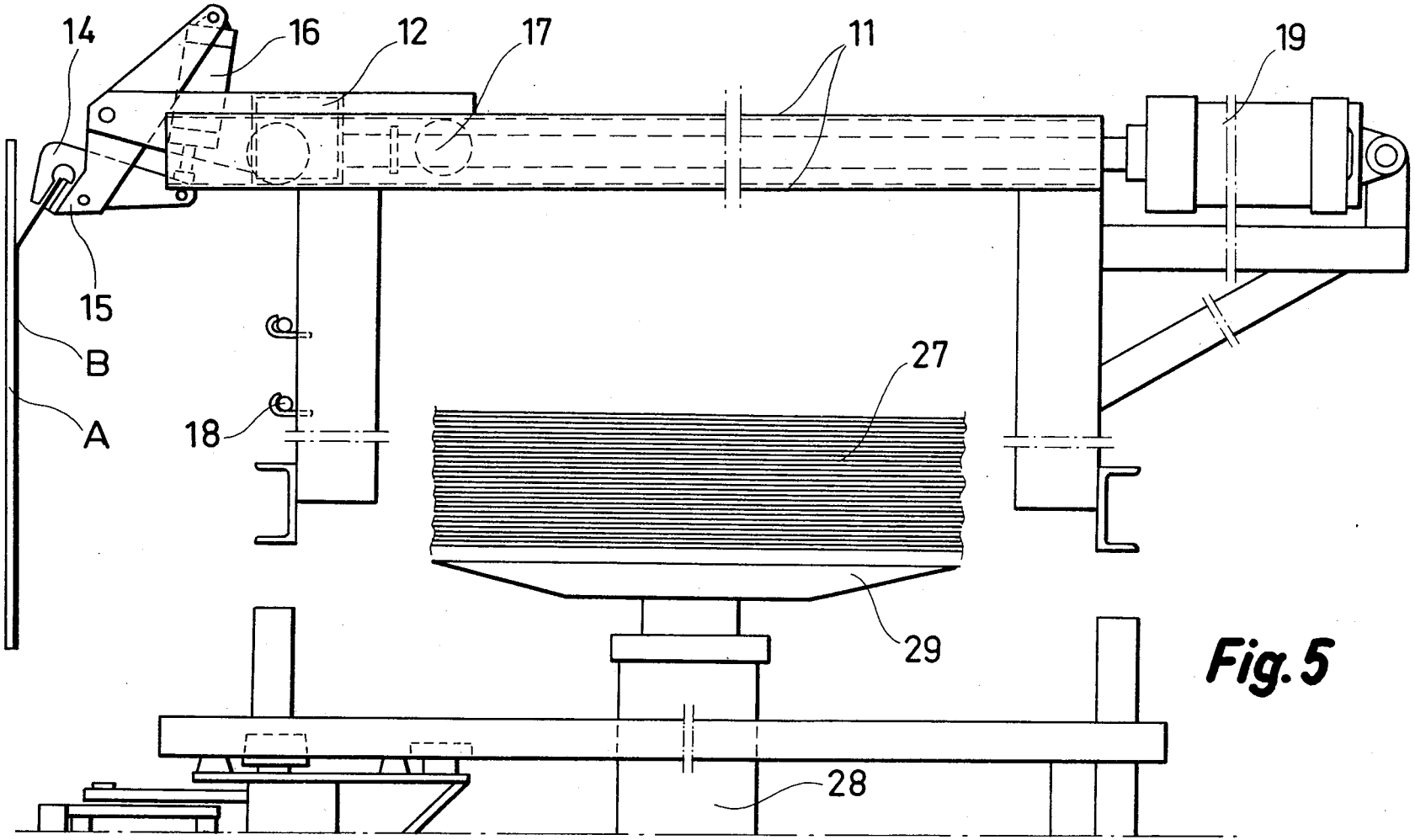
FIG. 5 shows the horizontal pulling device schematically.

In an industrial application as set forth in the invention, the number of conveyors 1, 2, and 3 (FIGS. 1–2) used can be three, for example. The base plates, i.e., the cathodes A lifted from the electrolysis tank, together with the sheets B grown on their both sides, are fed, for example, by means of a hoist or transfer carriages to conveyors 1. Through the conveyor washing station 4 they are transferred one by one to conveyor 2 and further in predetermined steps to the detachment station 5. After the detachment mechanism has peeled the metal sheets off, the base plates A continue to the coating station 6 (or to the maintenance track 7 for maintenance at determined intervals). After the coating, the base plates are transferred to conveyor 3 where they are respaced as required by the electrolysis tank, and the refill plate batch (e.g. 20 – 60 plates) required by the electrolysis is returned to the electrolysis tank.

After arriving at the detachment station 5 the plate is guided in place in its direction of movement by means of, for example, a guide groove 8 at the lower edge. The base plate A has preferably been provided with plastic or wooden edge lists 9, and pneumatic/hydraulic attachment shoes 10 lock the plate in place in the direction of movement and in the transversal and vertical directions.

The blade system 20 which performs the initial opening of the upper edge contains blades 21 which work with independent controls and limits on each side of the plate. These blades have been attached to the piston arm 23 of the working cylinder 22 in order to obtain a slanting downward movement. The cylinder 22 has been attached with bearings to a horizontal turning axle 24 so that the cylinder and the blade can turn freely around the axle to come in contact with the base plate A. A blade pressure which can be controlled over a wide range (0–200 kp) is created by cylinder 25, which at the detachment stage, through joint 26, causes the blade to be thrust on its moving track between the upper edges of the sheet B and the base plate A. At this point the sheet opens at the upper edge, either locally or over its entire width. When a control order returns the piston, cylinder 26 turns cylinder 22 and blade 21 away from the plate surface so that the upper edge opens more outwards. When the upper edge has opened, blade 21 returns to its initial position.

The horizontal pulling device, which consists of a carriage 12 which moves along guide rails 11, is moved by a pneumatic/hydraulic cylinder 19 to the pulling position so that the upper jaw 14 of the gripping member 13 is wound by means of working cylinder 16 around the opened upper edge of the sheet and the lower jaw 15 is set resiliently against the outer edge of the sheet, and the gripping jaws grip the sheet B.

The carriage 12 of the horizontal pulling device has been provided with guide wheels 17, which ensure a faultless pulling even if only one pair of jaws grips. On a control order, the carriage 12 moves along its horizontal track away from the base plate A, at which point the sheet B becomes detached from the base plate A and is turned by a block stop 18 to an almost horizontal position. The gripping jaws 14, 15 are opened on an opening order and the sheet falls on the sheet stack 27 of the stacking device. The stacking device consists of a hoist table 29; its cylinder 28 lowers the hoist table when more sheets are placed on it. Thus, the stacking level is kept constant with a tolerance of ± 10 mm by means of control signals. The hoist table has been provided with a hoist frame from where the completed load together with the hoist frame is transferred away from the system for a further process.

The horizontal pulling device works with such a great pulling force (e.g. 400 kp) that it is capable of detaching from each other sheet halves which are attached to each other at the lower edge (as is the case with zinc). Only in an exceptional case may an extra blade be used to detach sheets difficult to detach, blade which works when the pulling movement has already proceeded almost to the initial position and makes one controlled downward movement over the entire surface of the base plate on its one or both sides.

Figure 6:
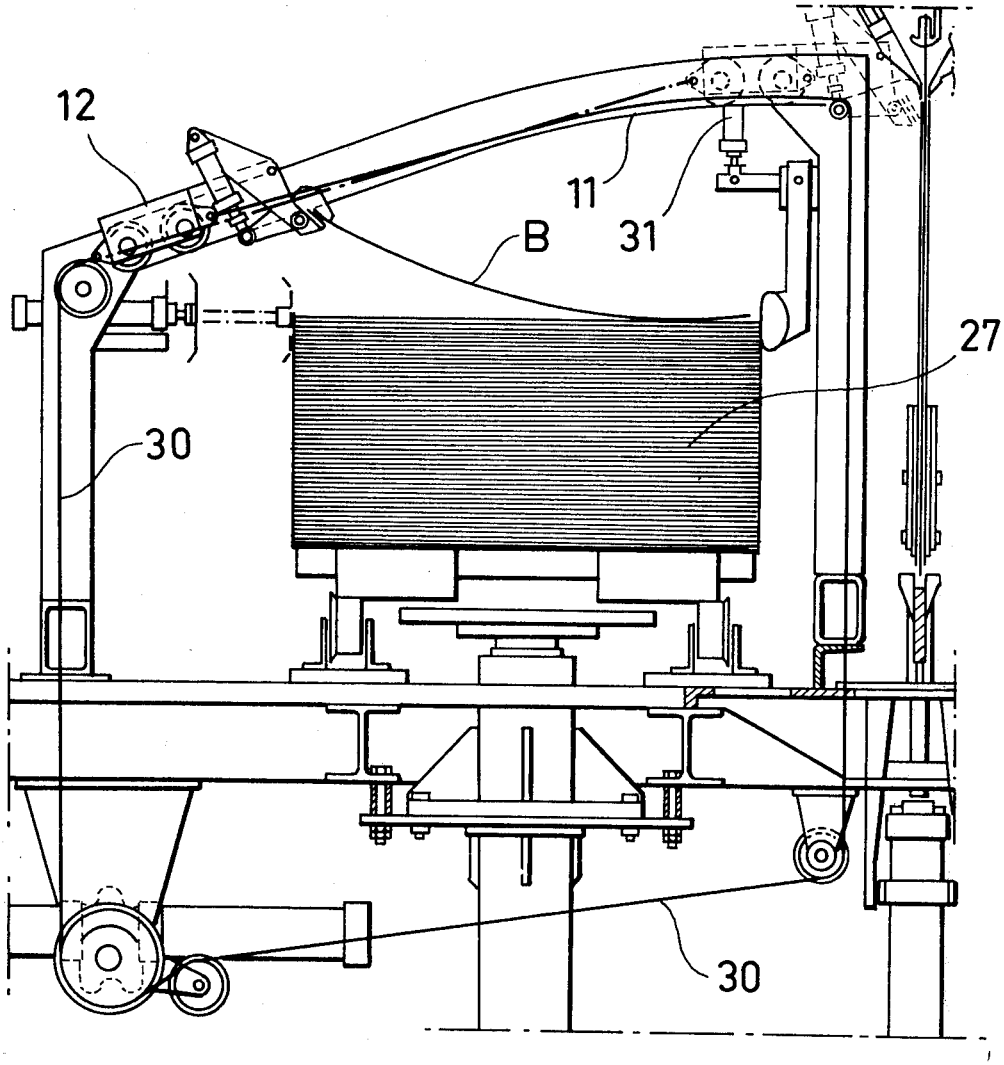
FIGS. 6 and 7 show two different embodiments of the driving members of the horizontal pulling device.

In the embodiment according to FIG. 6, the driving member of the pulling device is a chain 30 which moves along rails 11 or similar guides the carriage 12 which supports the gripping jaws. Working cylinder 31 turns the block stop away for the time of the turning movement of the stack 27.

Figure 7:
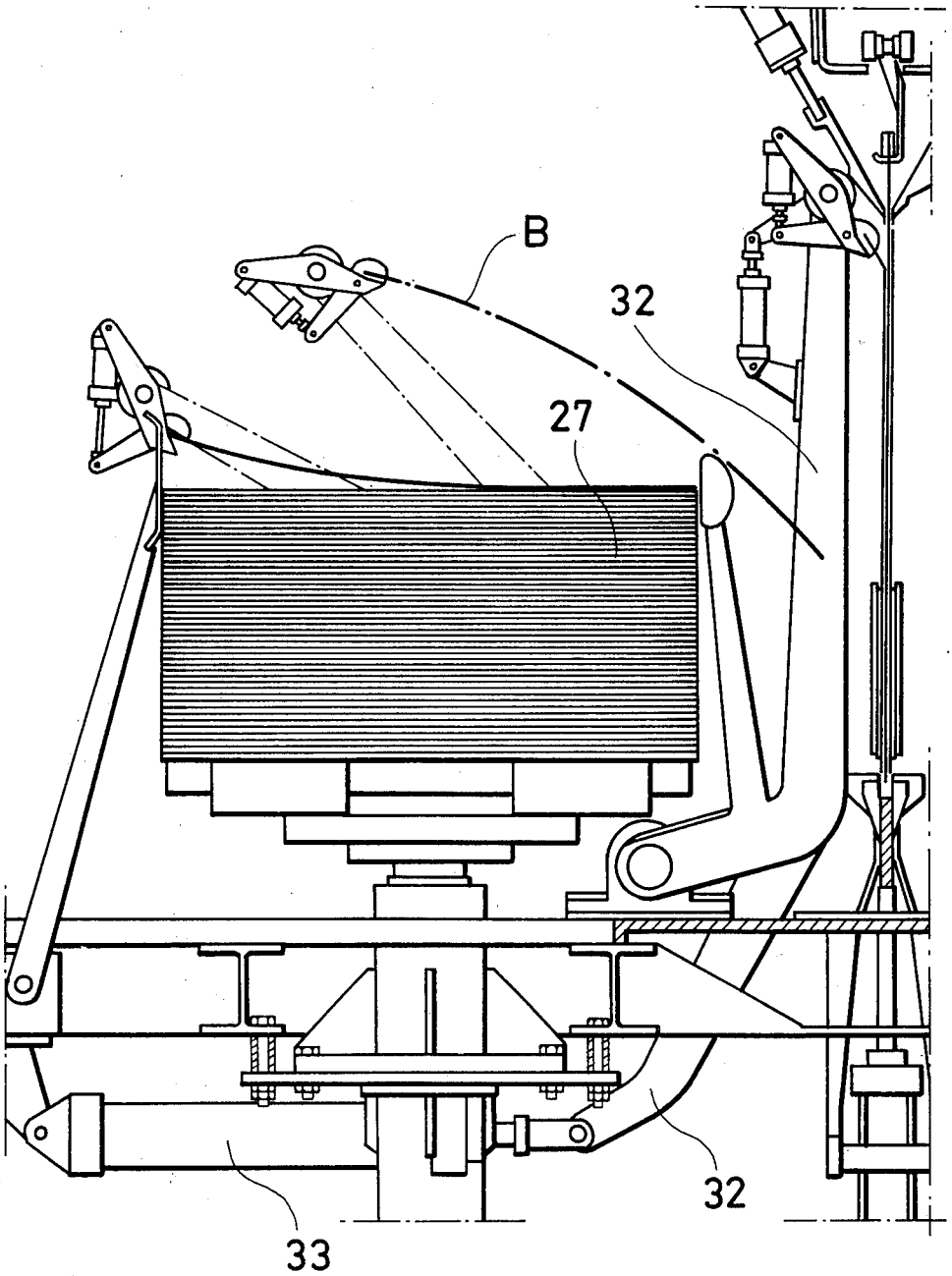

In FIG. 7, the gripping jaws with their driving members have been fitted at the upper end of a turning arm 32. This arm has been attached with bearings below the stack 27, and it obtains its turning movement from the working cylinder 33.

What is claimed is:

1. A device for detaching an electrolytically precipitated metal sheet, especially a copper, nickel or zinc sheet, from a base plate working as a cathode, which comprises:

means for holding the base plate rigidly in an essentially vertical position, blades mounted for limited downward movement to initially detach the upper edge of the precipitated metal sheet at least locally from the base plate by movement of said blades between said upper edge and said base plate, gripping jaws, for gripping the detached upper edge, said gripping jaws being carried by the upper end of a turning arm, said turning arm being pivotally mounted for movement between an upright position and a position at which the gripping jaws are horizontally displaced to an extent sufficient to detach the entire precipitated sheet from the base plate and to place the detached sheet on a sheet stacking device, said turning arm being driven by a working cylinder.

* * * * *